US008763373B2

(12) United States Patent
Park

(10) Patent No.: US 8,763,373 B2
(45) Date of Patent: Jul. 1, 2014

(54) SYSTEM FOR PURIFYING EXHAUST GAS AND METHOD FOR CONTROLLING THE SAME

(75) Inventor: Jae Beom Park, Seoul (KR)

(73) Assignee: Hyundai Motor Company, Seoul (KR)

( * ) Notice: Subject to any disclaimer, the term of this patent is extended or adjusted under 35 U.S.C. 154(b) by 202 days.

(21) Appl. No.: 13/315,586

(22) Filed: Dec. 9, 2011

(65) Prior Publication Data

US 2013/0014493 A1 Jan. 17, 2013

(30) Foreign Application Priority Data

Jul. 13, 2011 (KR) ..... 10-2011-0069546

(51) Int. Cl.
*F01N 3/00* (2006.01)

(52) U.S. Cl.
USPC ..... 60/295; 60/274; 60/297; 60/301

(58) Field of Classification Search
USPC ..... 60/274–324
See application file for complete search history.

(56) References Cited

U.S. PATENT DOCUMENTS

| | | | | |
|---|---|---|---|---|
| 4,404,796 | A | 9/1983 | Wade | |
| 6,293,096 | B1 * | 9/2001 | Khair et al. | 60/286 |
| 6,904,752 | B2 | 6/2005 | Foster et al. | |
| 6,912,847 | B2 * | 7/2005 | Deeba | 60/297 |
| 8,341,947 | B2 | 1/2013 | Hepburn et al. | |
| 2005/0016164 | A1 * | 1/2005 | Chiffey et al. | 60/297 |
| 2006/0059900 | A1 * | 3/2006 | Harada et al. | 60/297 |
| 2010/0005786 | A1 * | 1/2010 | Hinz et al. | 60/286 |
| 2010/0071656 | A1 | 3/2010 | Freese et al. | |
| 2011/0073088 | A1 | 3/2011 | Hubbard et al. | |
| 2011/0120090 | A1 | 5/2011 | Sorensen, Jr. | |
| 2011/0203258 | A1 | 8/2011 | Makartchouk et al. | |
| 2011/0258993 | A1 * | 10/2011 | Goersmann et al. | 60/297 |

FOREIGN PATENT DOCUMENTS

| | | |
|---|---|---|
| JP | 2010-106753 | 5/2010 |
| KR | 10-0960234 | 5/2010 |
| KR | 10-2011-0024598 | 3/2011 |

* cited by examiner

*Primary Examiner* — Jesse Bogue
(74) *Attorney, Agent, or Firm* — Morgan, Lewis & Bockius LLP

(57) ABSTRACT

A system for purifying an exhaust gas may include a lean NOx trap (LNT) catalyst adapted to absorb nitrogen oxides contained in the exhaust gas at a lean atmosphere, release the absorbed nitrogen oxides at a rich atmosphere, and reduce or slip the released nitrogen oxides according to a temperature thereof; a particulate filter adapted to trap particulate matters contained in the exhaust gas and regenerate the trapped particulate matters by using the nitrogen oxides slipped from the LNT catalyst; and a controller adapted to selectively create the rich atmosphere when the temperature of the LNT catalyst is higher than or equal to a first predetermined temperature or a temperature of the particulate filter is higher than or equal to a second predetermined temperature. A method for controlling the system is also disclosed.

4 Claims, 5 Drawing Sheets

SYSTEM FOR PURIFYING EXHAUST GAS AND METHOD FOR CONTROLLING THE SAME

CROSS-REFERENCE TO RELATED APPLICATION

The present application claims priority of Korean Patent Application Number 10-2011-0069546 filed in the Korean Intellectual Property Office on Jul. 13, 2011, the entire contents of which application is incorporated herein for all purposes by this reference.

BACKGROUND OF INVENTION

1. Field of Invention

The present invention relates to a system for purifying an exhaust gas and a method for controlling the same. More particularly, the present invention relates to a system for purifying an exhaust gas and a method for controlling the same which releases nitrogen oxides from a lean NOx trap (LNT) catalyst and reduces or slips the released nitrogen oxides so as to use the released nitrogen oxides for regeneration of a particulate filter by creating a rich atmosphere according to a temperature of the LNT catalyst and a temperature of the particulate filter.

2. Description of Related Art

Generally, exhaust gas flowing out through an exhaust manifold from an engine is driven into a catalytic converter mounted at an exhaust pipe and is purified therein. After that, the noise of the exhaust gas is decreased while passing through a muffler and then the exhaust gas is emitted into the air through a tail pipe.

A denitrification catalyst (DeNOx catalyst) is one type of such a catalytic converter and purifies nitrogen oxides (NOx) contained in the exhaust gas. If reducing agents such as urea, ammonia, carbon monoxide, and hydrocarbon (HC) are supplied to the exhaust gas, the NOx contained in the exhaust gas is reduced in the DeNOx catalyst through oxidation-reduction reaction with the reducing agents.

Recently, a lean NOx trap (LNT) catalyst is used as such a DeNOx catalyst. The LNT catalyst absorbs the NOx contained in the exhaust gas when the engine operates in a lean atmosphere, and releases the absorbed NOx when the engine operates in a rich atmosphere.

Meanwhile, a particulate filter for trapping particulate matters (PM) contained in the exhaust gas is mounted on the exhaust pipe. If excess soot is trapped in the particulate filter, it is difficult for the exhaust gas to pass the particulate filter and a pressure of the exhaust gas increases. If the pressure of the exhaust gas is high, engine performance may be deteriorated and the particulate filter may be damaged. Therefore, if an amount of the soot trapped in the particulate filter is larger than or equal to a predetermined amount, a temperature of the exhaust gas is raised so as to burn the soot trapped in the particulate filter. Such a process is called a regeneration of the particulate filter.

The regeneration of the particulate filter is divided into a passive regeneration and an active regeneration. The passive regeneration is performed by supplying the nitrogen dioxides ($NO_2$) required for regenerating the soot from the nitrogen oxides contained in exhaust gas. On the contrary, the active regeneration is performed by post-injecting fuel to a combustion chamber of the engine. In the active regeneration, the post-injected fuel is oxidized so as to generate oxidation heat and the soot trapped in the particulate filter is burnt by the oxidation heat. In a case of the active regeneration, since a regeneration temperature is high, large energy is required for entering the regeneration process. Therefore, regeneration period is long so as to prevent energy consumption. In the passive regeneration, compared with the active regeneration, a regeneration temperature is low and thus small energy is required for entering the regeneration process. Therefore, regeneration period is short.

If the active regeneration is performed too frequently, fuel consumption is deteriorated and oil dilution occurs. To solve such problems, a volume of the particulate filter needs to be larger than 2.5 L.

In a case that the LNT catalyst, however, is disposed at an upstream of the particulate filter, the nitrogen dioxides ($NO_2$) contained in the exhaust gas are absorbed at the LNT catalyst and thus the passive regeneration of the particulate filter is hindered.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to provide a system for purifying an exhaust gas and a method for controlling the same having advantages of regenerating a particulate filter passively by slipping nitrogen dioxides ($NO_2$) released from a LNT catalyst when a passive regeneration of the particulate filter is possible in a system in which the LNT catalyst and the particulate filter are sequentially disposed.

Exemplary systems for purifying an exhaust gas according to the present invention may include: a lean NOx trap (LNT) catalyst adapted to absorb nitrogen oxides contained in the exhaust gas at a lean atmosphere, release the absorbed nitrogen oxides at a rich atmosphere, and reduce or slip the released nitrogen oxides according to a temperature thereof; a particulate filter adapted to trap particulate matters contained in the exhaust gas and regenerate the trapped particulate matters by using the nitrogen oxides slipped from the LNT catalyst; and a controller adapted to selectively create the rich atmosphere when the temperature of the LNT catalyst is higher than or equal to a first predetermined temperature or a temperature of the particulate filter is higher than or equal to a second predetermined temperature.

The LNT catalyst may be adapted to absorb the nitrogen oxides contained in the exhaust gas as nitrate form and to release the absorbed nitrogen oxides as nitrogen dioxide form.

The nitrogen dioxides ($NO_2$) released from the LNT catalyst may be reduced to nitrogen gas in a case that the temperature of the LNT catalyst is higher than or equal to the first predetermined temperature.

The nitrogen dioxides ($NO_2$) released from the LNT catalyst may be slipped in a case that the temperature of the LNT catalyst is lower than the first predetermined temperature.

The nitrogen dioxides ($NO_2$) slipped from the LNT catalyst may be used for regenerating the particulate matters in a case that the temperature of the particulate filter is higher than or equal to the second predetermined temperature.

Exemplary methods for controlling the same according to the present invention may include: determining whether a temperature of the LNT catalyst is higher than or equal to a first predetermined temperature during operation of an engine; and releasing the nitrogen dioxides ($NO_2$) from the LNT catalyst by creating a rich atmosphere and reducing the released nitrogen dioxides ($NO_2$) in a case that the temperature of the LNT catalyst is higher than or equal to the first predetermined temperature.

In a case that the temperature of the LNT catalyst is lower than the first predetermined temperature, the method may further include: determining whether a temperature of the particulate filter is higher than or equal to a second predetermined temperature; releasing the nitrogen dioxides ($NO_2$) from the LNT catalyst by creating the rich atmosphere in a case that the temperature of the particulate filter is higher than or equal to the second predetermined temperature; and then slipping the released nitrogen dioxides ($NO_2$) and regenerating the particulate filter by using the slipped nitrogen dioxides ($NO_2$).

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Figure 1:
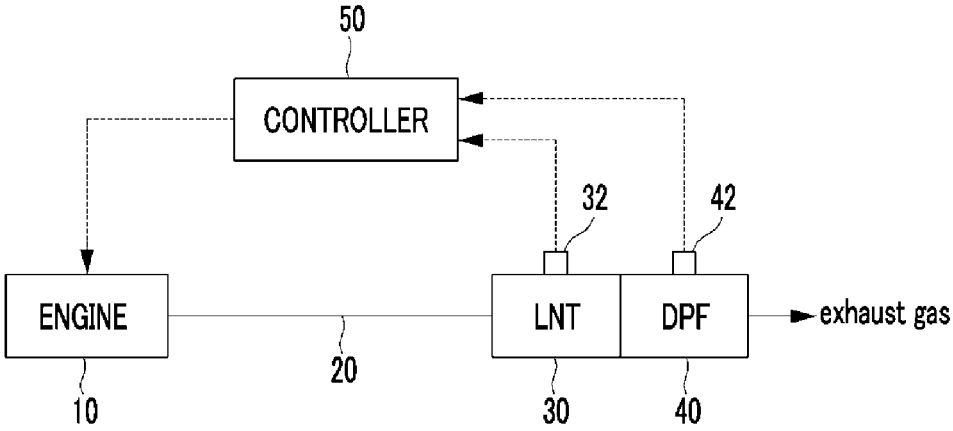
FIG. 1 is a schematic diagram of an exemplary system for purifying an exhaust gas according to the present invention.

As shown in FIG. 1, a system for purifying an exhaust gas according to various embodiments of the present invention includes an engine 10, an exhaust pipe 20, a lean NOx trap (LNT) catalyst 30, a particulate filter 40, and a controller 50.

The engine 10 burns an air-fuel mixture in which fuel and air are mixed so as to convert chemical energy into mechanical energy. The engine 10 is connected to an intake manifold so as to receive the air in a combustion chamber, and is connected to an exhaust manifold such that an exhaust gas generated in a combustion process is gathered in the exhaust manifold and is exhausted to the exterior. An injector is mounted at the combustion chamber so as to inject the fuel into the combustion chamber.

The exhaust pipe 20 is connected to the exhaust manifold so as to exhaust the exhaust gas to the exterior of the vehicle. The LNT catalyst 30 and the particulate filter 40 are mounted on the exhaust pipe 20 so as to remove particulate matters (PM) and nitrogen oxides contained in the exhaust gas.

In various embodiments, the exhaust pipe 20 is provided with a turbo charger for increasing an intake by using exhaust energy, an oxidation catalyst for oxidizing hydrocarbon and carbon monoxide contained in the exhaust gas, and a selective catalytic reduction catalyst for removing nitrogen oxides, hydrocarbon, and carbon monoxide contained in the exhaust gas.

The LNT catalyst 30 is mounted on the exhaust pipe 20 and the exhaust gas flowing out from the engine 10 is adapted to pass through the LNT catalyst 30. The LNT catalyst 30 is adapted to absorb nitrogen oxides contained in the exhaust gas at a lean atmosphere and to release the absorbed nitrogen oxides at a rich atmosphere. At this time, the LNT catalyst 30 absorbs the nitrogen oxides as nitrate form and releases the nitrogen oxides as nitrogen dioxide form. In addition, the LNT catalyst 30 is adapted to reduce the released nitrogen dioxides ($NO_2$) into nitrogen gas if a temperature of the LNT catalyst 30 is higher than or equal to a first predetermined temperature, and the LNT catalyst 30 slips the released nitrogen dioxides ($NO_2$) if the temperature of the LNT catalyst 30 is lower than the first predetermined temperature. The LNT catalyst 30 includes noble metals and absorbent materials. The noble metals include platinum, palladium, and rhodium, and the absorbent materials includes weak basic materials, for example barium carbonate. However, a range of the present invention is not limited to the noble metals or the absorbent materials exemplified herein.

The particulate filter 40 is mounted on the exhaust pipe 20 downstream of the LNT catalyst 30. The particulate filter 40 traps particulate matters (or soot) contained in the exhaust gas flowing through the exhaust pipe 20. In addition, the particulate filter 40 is adapted to regenerate the trapped soot passively by using the nitrogen oxides (e.g., nitrogen dioxide) slipped from the LNT catalyst 30. Since the particulate filter 40 is adapted to be regenerated passively whenever the nitrogen oxides (or nitrogen dioxide) is slipped from the LNT catalyst 30, the active regeneration of the particulate filter 40 can be excluded. Therefore, fuel economy may be improved. In addition, if the active regeneration is excluded, a pressure sensor for detecting a pressure difference between an inlet and an outlet of the particulate filter 40 can be removed. Therefore, cost may be reduced.

In various embodiments, temperature sensors 32 and 42 are mounted respectively at the LNT catalyst 30 and the particulate filter 40. The first temperature sensor 32 detects a temperature of the LNT catalyst 30, and the second temperature sensor 42 detects a temperature of the particulate filter 40. The system for purifying the exhaust gas according to various embodiments of the present invention is controlled based on the values detected by the first and second temperature sensors 32 and 42.

Meanwhile, in various embodiments the temperatures of the LNT catalyst 30 and the particulate filter 40 are predicted based on operating conditions of the engine (e.g., fuel injection amount, fuel injection timing, engine operation history, and so on). Instead of mounting the temperature sensors 32 and 42, the system for purifying the exhaust gas according to various embodiments of the present invention is controlled based on the predicted temperatures.

The controller 50 controls the system for purifying the exhaust gas according to various embodiments of the present invention. For this purpose, the controller 50 is electrically connected to the first and second temperature sensors 32 and 42 so as to receive the temperatures detected by the first and second temperature sensors 32 and 42, determines whether the released nitrogen oxides from the LNT catalyst 30 is reduced or slipped based on the temperatures, and controls combustion atmosphere of the engine. The combustion atmosphere of the engine is controlled by controlling the injected fuel amount. That is, if the fuel amount injected to the engine 10 increases, the combustion atmosphere becomes rich. On the contrary, if the fuel amount injected to the engine 10 decreases, the combustion atmosphere becomes lean. The control of the combustion atmosphere of the engine is well known to a person of an ordinary skill in the art, and thus a detailed description thereof will be omitted.

In addition, the controller 40 can operate based on the predicted temperatures of the LNT catalyst 30 and the particulate filter 40 as described above.

Figure 2:
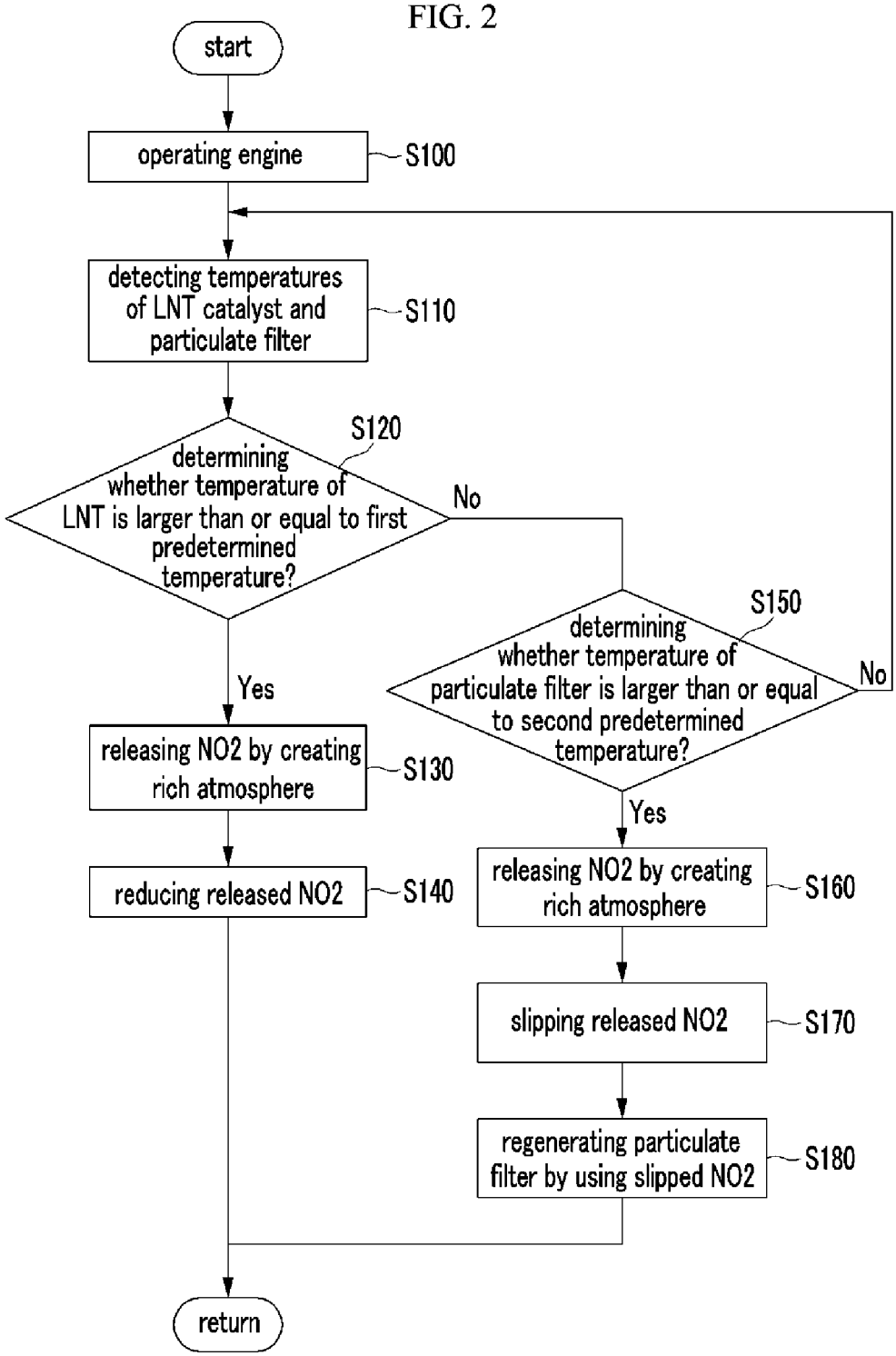
FIG. 2 is a flowchart of an exemplary method for controlling an exemplary system for purifying an exhaust gas according to the present invention.

As shown in FIG. 2, a control of the system for purifying the exhaust gas according to various embodiments of the present invention is done when the engine operates at a step S100. If the engine 10 operates, the first and second temperature sensors 32 and 42 detect the temperatures of the LNT catalyst 30 and the particulate filter 40 at a step S110 and transmits the detected temperatures to the controller 50.

The controller 50 determines whether the temperature of the LNT catalyst 30 is higher than or equal to a first predetermined temperature at a step S120. The first predetermined temperature means a temperature where the released nitrogen oxides can be reduced in the LNT catalyst 30. The first predetermined temperature may be, for example, 300° C., but can be set at other appropriate values.

If the temperature of the LNT catalyst 30 is higher than or equal to the first predetermined temperature at the step S120, the controller 50 controls the engine 10 so as to create the rich atmosphere and releases the nitrogen dioxides ($NO_2$) from the LNT catalyst 30 at a step S130.

After that, the released nitrogen dioxides ($NO_2$) are reduced to nitrogen gas in the LNT catalyst 30 at a step S140, and the method according to various embodiments of the present invention finishes.

If the temperature of the LNT catalyst 30 is lower than the first predetermined temperature at the step S120, the controller 50 determines whether the temperature of the particulate filter 40 is higher than or equal to the second predetermined temperature at a step S150. The second predetermined temperature means a temperature where the particulate filter 40 can be regenerated passively. The second predetermined temperature is, for example, 350° C., but can be set at other appropriate values.

If the temperature of the particulate filter 40 is lower than the second predetermined temperature at the step S150, the controller 50 returns to the step S110.

If the temperature of the particulate filter 40 is higher than or equal to the second predetermined temperature at the step S150, the controller 50 controls the engine 10 so as to create the rich atmosphere and releases the nitrogen dioxides ($NO_2$) from the LNT catalyst 30 at a step S160.

After that, the released nitrogen dioxides ($NO_2$) are slipped from the LNT catalyst 30 at a step S170 and is supplied to the particulate filter 40.

The nitrogen dioxides ($NO_2$) supplied to the particulate filter 40 are reduced in the particulate filter 40 and supplies oxygen required for regenerating the soot. Accordingly, the particulate filter 40 is regenerated passively at a step S180, and the method according to various embodiments of the present invention is finished.

Meanwhile, the method according to various embodiments of the present invention is performed continuously when the engine 10 is operated.

Figure 3:
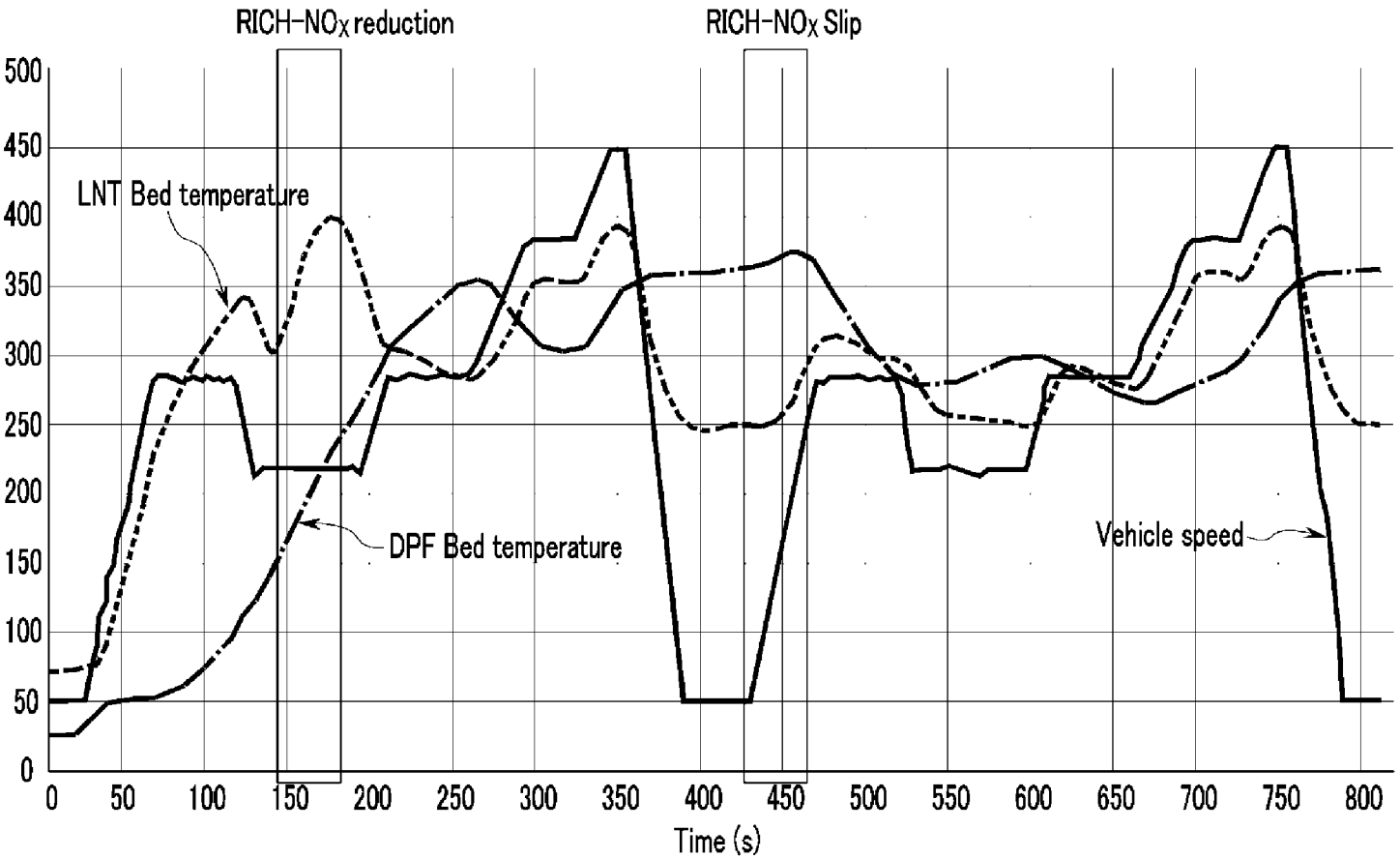
FIG. 3 is a graph showing conditions applicable to a method for controlling an exemplary system for purifying an exhaust gas according to the present invention.

FIG. 3 is a graph showing conditions applicable to a method for controlling a system for purifying an exhaust gas according to various embodiments of the present invention.

In FIG. 3, a left box shows conditions at which the nitrogen oxides can be reduced in the LNT catalyst 30. That is, in a case that the temperature of the LNT catalyst 30 is high, the controller 50 creates the rich atmosphere so as to release the absorbed nitrogen oxides from the LNT catalyst 30 and the released nitrogen oxides is reduced to the nitrogen gas in the LNT catalyst 30.

In FIG. 3, a right box shows conditions at which the nitrogen oxides can be slipped from the LNT catalyst 30 and the particulate filter 40 can be regenerated. That is, in a case that the temperature of the LNT catalyst 30 is low and the temperature of the particulate filter 40 is high, the controller 50 creates the rich atmosphere so as to release the absorbed nitrogen oxides from the LNT catalyst 30. Since the temperature of the LNT catalyst 30 is low, the released nitrogen oxides cannot be reduced in the catalyst 30 and is slipped. The slipped nitrogen oxides is reduced in the particulate filter 40 and regenerates the particulate filter 40.

Figure 4:
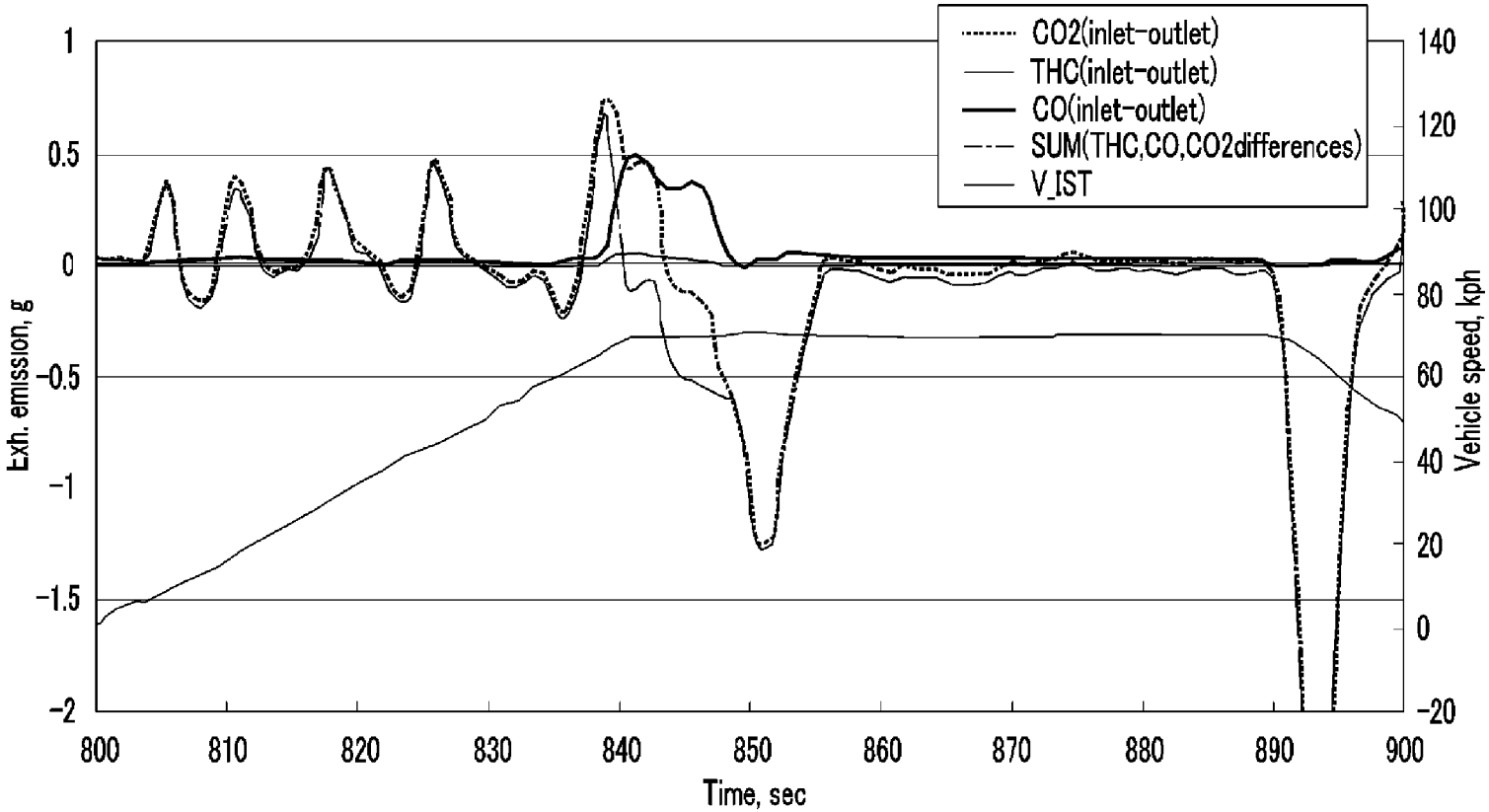
FIG. 4 is a graph showing a regeneration amount in a case that a particulate filter is regenerated passively.

FIG. 4 is a graph showing a regeneration amount in a case that a particulate filter is regenerated passively. A dotted line represents a CO2 difference between an inlet and an outlet of the particulate filter 40, a thin solid line represents a THC difference between the inlet and the outlet of the particulate filter 40, and a bold solid line represents a CO difference between the inlet and the outlet of the particulate filter 40. In addition, a one-point chain line represents a sum of the differences, and the sum is the same as a soot amount regenerated in the particulate filter 40.

Referring to FIG. 4, a maximum soot regeneration amount is about 1.2 g/sec, an average soot regeneration is about 0.8 g/sec, and a time required for the passive regeneration is about 7 second. It is assumed that the passive regeneration is performed at every 10 km when a vehicle runs to 500 km, the soot of 280 g is regenerated.

Figure 5:
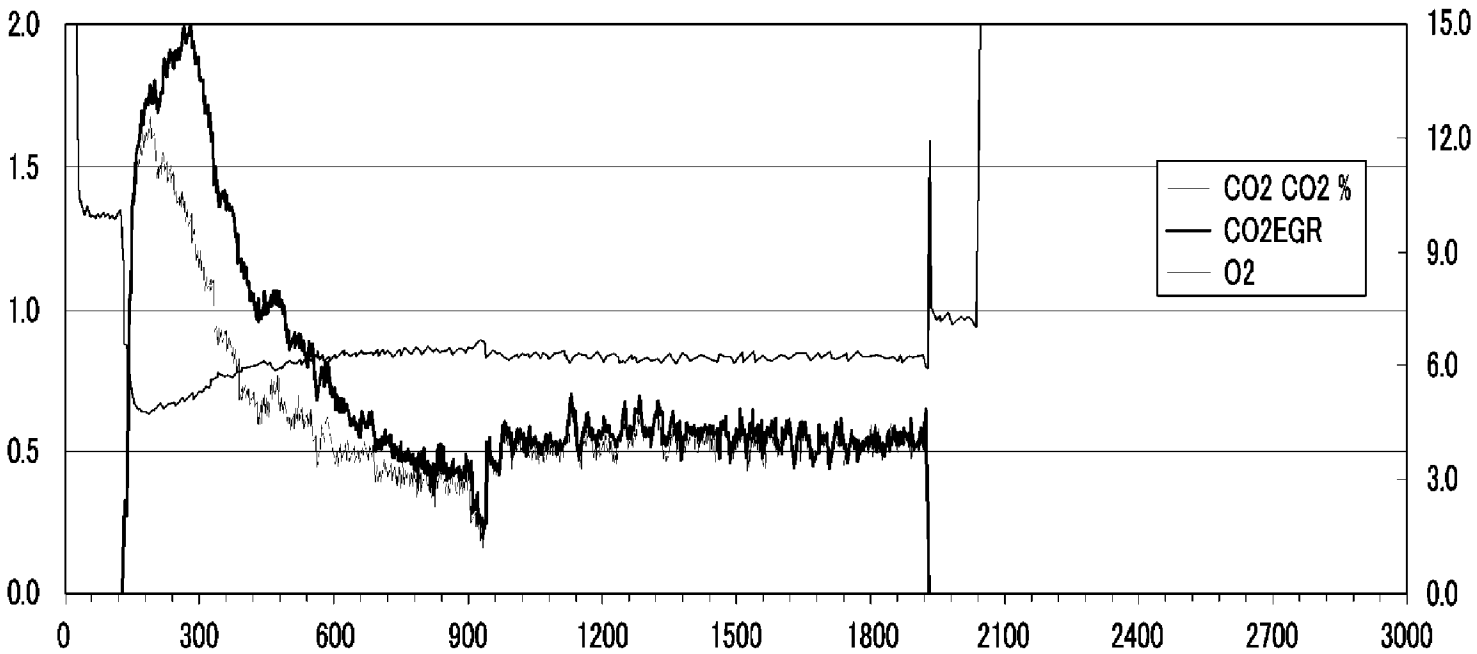
FIG. 5 is a graph showing a regeneration amount in a case that a particulate filter is regenerated forcibly.

FIG. 5 is a graph showing a regeneration amount in a case that a particulate filter is regenerated forcibly. The soot regenerated is represented by a difference between a bold solid line and a thin solid line. Referring to FIG. 5, a maximum soot regeneration amount is about 0.65 g/sec, an average soot regeneration amount is about 0.8 g/sec, and a time required for the active regeneration is 1000 second. When a vehicle runs to 500 km, the particulate filter 40 is regenerated once and the soot of 300 g is regenerated.

The soot regeneration amount when the soot is regenerated passively according to various embodiments of the present invention is similar to that when the soot is regenerated forcibly.

As described above, since a particulate filter is regenerated passively, exhaust may be reduced and fuel economy may be improved according to various embodiments of the present invention.

Since the particulate filter has a passive regeneration period shorter than a active regeneration period, volume of the particulate filter may be reduced.

For convenience in explanation and accurate definition in the appended claims, the terms left or right, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for purifying an exhaust gas, comprising:

a lean NOx trap (LNT) catalyst adapted to absorb nitrogen oxides contained in the exhaust gas at a lean atmosphere, release the absorbed nitrogen oxides at a rich atmosphere, and reduce or slip the released nitrogen oxides according to a temperature thereof;

a particulate filter adapted to trap particulate matters contained in the exhaust gas and regenerate the trapped particulate matters by slipped from the LNT catalyst; and a controller adapted to selectively create the rich atmosphere when the temperature of the LNT catalyst is higher than or equal to a first predetermined temperature or a temperature of the particulate filter is higher than or equal to a second predetermined temperature;

wherein the LNT catalyst is adapted to absorb the nitrogen oxides contained in the exhaust gas as nitrates and to release the absorbed nitrogen oxides as nitrogen dioxides ($NO_2$); and wherein the nitrogen dioxides ($NO_2$) released from the LNT catalyst are slipped in a case that the temperature of the LNT catalyst is lower than the first predetermined temperature.

2. The system of claim 1, wherein the nitrogen dioxides ($NO_2$) released from the LNT catalyst are reduced to a nitrogen gas in a case that the temperature of the LNT catalyst is higher than or equal to the first predetermined temperature.

3. The system of claim 1, wherein the nitrogen dioxides ($NO_2$) slipped from the LNT catalyst are used for regenerating the particulate matters in a case that the temperature of the particulate filter is higher than or equal to the second predetermined temperature.

4. A method for controlling a system for purifying an exhaust gas that comprises a lean NOx trap (LNT) catalyst adapted to absorb or release nitrogen oxides contained in the exhaust gas and a particulate filter disposed at a downstream of the LNT catalyst and adapted to trap particulate matters contained in the exhaust gas, the method comprising:

determining whether a temperature of the LNT catalyst is higher than or equal to a first predetermined temperature during operation of an engine;

releasing the nitrogen dioxides ($NO_2$) from the LNT catalyst by creating a rich atmosphere and reducing the released nitrogen dioxides ($NO_2$) in a case that the temperature of the LNT catalyst is higher than or equal to the first predetermined temperature;

determining whether a temperature of the particulate filter is higher than or equal to a second predetermined temperature in a case that the temperature of the LNT catalyst is lower than the first predetermined temperature; and releasing the nitrogen dioxides ($NO_2$) from the LNT catalyst by creating the rich atmosphere, slipping the released nitrogen dioxides ($NO_2$), and regenerating the particulate filter by using the slipped nitrogen dioxides ($NO_2$) in a case that the temperature of the particulate filter is higher than or equal to the second predetermined temperature.

* * * * *